US008905285B2

(12) United States Patent
Sugihara et al.

(10) Patent No.: US 8,905,285 B2
(45) Date of Patent: Dec. 9, 2014

(54) ELECTRIC STAPLER

(75) Inventors: Shinpei Sugihara, Tokyo (JP); Nobuaki Yagi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 436 days.

(21) Appl. No.: 12/847,390

(22) Filed: Jul. 30, 2010

(65) Prior Publication Data

US 2011/0042438 A1 Feb. 24, 2011

(30) Foreign Application Priority Data

Aug. 24, 2009 (JP) ..... 2009-192970

(51) Int. Cl.
*B25C 1/06* (2006.01)
*B27F 7/21* (2006.01)
*B42B 4/00* (2006.01)

(52) U.S. Cl.
CPC .... *B27F 7/21* (2013.01); *B42B 4/00* (2013.01)
USPC ..... 227/131; 227/129

(58) Field of Classification Search
USPC ..... 227/82, 86, 87, 92, 129, 131
See application file for complete search history.

(56) References Cited

U.S. PATENT DOCUMENTS

| | | | | |
|---|---|---|---|---|
| 3,524,575 | A | 8/1970 | Hurkmans et al. | |
| 4,262,836 | A * | 4/1981 | Hirose | 227/110 |
| 4,367,111 | A | 1/1983 | Hirose | |
| 5,098,002 | A * | 3/1992 | Hansch et al. | 227/90 |
| 5,150,826 | A * | 9/1992 | Logtens | 227/88 |
| 2003/0042286 | A1 * | 3/2003 | Yoshie | 227/130 |
| 2006/0157530 | A1 * | 7/2006 | Yagi | 227/155 |
| 2006/0273133 | A1 | 12/2006 | Kanai et al. | |

FOREIGN PATENT DOCUMENTS

| | | |
|---|---|---|
| EP | 1932638 A1 * | 6/2008 |
| JP | 6-063342 | 9/1994 |
| JP | 2005-314029 | 11/2005 |
| JP | 2007-111841 | 5/2007 |

* cited by examiner

*Primary Examiner* — Andrew M Tecco
*Assistant Examiner* — Nathaniel Chukwurah
(74) *Attorney, Agent, or Firm* — Drinker Biddle & Reath LLP

(57) ABSTRACT

An electric stapler is provided with: a driver unit including a driver for striking out a staple to be penetrated through sheets of paper; and a clincher unit including a clincher for bending leg portions of the staple penetrated through the sheets of paper. The driver unit is provided with: a staple storage portion for storing therein a large number of connected staples; a head portion for striking out the staple; a drive portion configured to drive said driver provided slidably in the head portion; and a head raise/lower mechanism configured to relatively move the head portion with respect to the staple storage portion toward the clincher unit to thereby clamp the sheets of paper.

9 Claims, 14 Drawing Sheets

ELECTRIC STAPLER

BACKGROUND OF THE INVENTION

1. Field of the Invention

The present invention relates to an electric stapler provided with a driver unit including a driver for striking out a staple to bind sheets of paper and a clincher unit including a clincher for bending the staple struck out and penetrated through the sheets of paper.

2. Related Art

Patent reference 1 and Patent Reference 2 disclose vertically separated type saddle stitching staplers in which centers of paper bundles are bound. In an operation using these staplers, a central portion of the sheets of paper are bent, the portion are thereafter inserted into a binding space between a driver unit and a clincher unit, then the sheets of paper are bound. Since the bent portions of the centers of the sheets of paper are stacked in a manner that the centers direct upward, it is general to dispose the driver unit in an upper side and the clincher unit in a lower side. However, in this structure, since the stacking height of the bent portions tends to be high, in order to prevent the high bent portions from interfering, it is necessary to spread the binding space intervening between the two units. Especially, in order to be able to bind about fifty sheets of paper, the binding space must be spread considerably widely.

Also, when binding the sheets of paper, the driver unit or clincher unit is projected toward its partner so that the binding space is thereby narrowed; the paper bundle is clamped; the driver is driven to penetrate the staple through the sheets of paper; and then the sheets of paper are clinched by the clincher unit. Normally, since bent sheets of paper are stacked and set on the clincher unit, a clamp mechanism is disposed on the driver unit side and the driver unit is moved down to clamp the bundle of the sheets of paper. In this case, in a structure in which the whole of the driver unit is moved down using a separate mechanism, an apparatus having such structure becomes large in size. In view of this, there is employed a clamp structure in which, of the driver unit, a staple storage portion and a head portion including the periphery of the driver are separated from a drive portion for driving the driver and the like, and the staple storage portion and head portion are moved down to thereby clamp the sheets of paper (see the patent reference 1). The reason why such structure is employed is that, it is believed that the staple storage portion and head portion cannot be separated from each other, since a leading staple is fed out to the strike-out portion from the staple storage portion in which a large number of staples are stored and the thus fed-out leading staple is then struck out using the driver.

Here, in the case that the binding space is set wide, the range of a vertical movement of the head portion of the driver unit also widens. Since the movable portion of the electric stapler, which includes the staple storage portion and head portion, includes such staple storage portion as contains therein about 5000 to 7000 pieces of connected staples, the movable portion is heavy in weight. Thus, the load of a current necessary for driving the heavy movable portion greatly in the vertical direction is inevitably large and noises generated when the electric stapler is in operation also become loud accordingly.

Also, when the considerable heavy movable portion moves up and down suddenly, the connected portions of the connected staples within the staple storage portion can be separated from each other due to vibrations caused by the sudden vertical movement of the movable portion, and a feed pawl for supplying the connected staples to the strike-out portion can be caused to come off due to the bouncing movements of the connected staples, thereby raising a possibility that poor staple feed can occur.

Further, as the staples are consumed or new staples are supplied, the number of staples contained within the staple storage portion decreases or increases, whereby the weight of the staple storage portion decreases or increases. Therefore, when the staple storage portion and head portion move integrally, the center of gravity of the whole of the moving portion varies accordingly, whereby the binding core position is made easy to change. In addition to this, when the stroke of the moving portion in the vertical movement thereof is large and also the staple storage portion bounces, the binding positions of the staples are caused to vary, thereby raising a possibility that the binding of the papers by the staples can be unstable.

Further, Patent Reference 3 is a reference disclosing a stapler in which a straight staple is formed into a U-shape, and then the formed U-shape staple is driven into sheets of paper.

[Patent Reference 1] JP-U-06-063342
[Patent Reference 2] JP-A-2005-314029
[Patent Reference 3] US 2006/0273133

SUMMARY OF THE INVENTION

One or more embodiments of the invention provide an electric stapler, in which a part movable up and down for clamping sheets of paper is reduced in size to reduce an operation weight thereof, whereby, even when a binding space is set large, a stable paper binding can always be secured.

In accordance with one or more embodiments of the invention, an electric stapler is provided with: a driver unit 1 including a driver 11 for striking out a staple s to be penetrated through sheets of paper P; and a clincher unit 2 including a clincher for bending leg portions s1 of the staple s penetrated through the sheets of paper. The driver unit 2 is provided with: a staple storage portion 3 for storing therein a large number of connected staples SS; a head portion 4 for striking out the staple s; a drive portion 5 configured to drive said driver 11 provided slidably in the head portion 4; and a head raise/lower mechanism 13, 33 configured to relatively move the head portion 4 with respect to the staple storage portion 3 toward the clincher unit 2 to thereby clamp the sheets of paper P.

According to the above structure, since, when binding the sheets of paper, only the head portion is moved from the driver unit toward the clincher unit by the head raise/lower mechanism to clamp the sheets of paper, when compared with a structure in which the head portion is moved together with the staple storage portion, a load necessary to move the head portion is small and the size of the paper clamp mechanism can be reduced; and further, the paper binding speed can also be increased. Here, as the number of staples stored within the staple storage portion increases or decreases, the weight of the staple storage portion increases or decreases. However, according to the invention, since the staple storage portion with its weight variable is not moved but only the head portion with its weight not variable is moved, the center of gravity of the paper clamp mechanism is constant and thus the center position of binding by the staple can be stabilized. Therefore, the proper paper binding can always be secured.

In the above structure, the head portion 4 may include: a strike-out portion 7 formed to open in the staple storage portion 3; said driver 11 for striking out a leading staple supplied from the staple storage portion 3 to the strike-out portion 7; and a staple holding portion 20 formed on a strike-out side of the strike-out portion 20. The head raise/lower mechanism may include: an operation member 13 engageable with the driver 11 so that the driver 11 moves the leading staple existing within the strike-out portion 7 to the holding portion and also engageable with the head portion 4 to move the head portion 4 toward the clincher unit 2 to thereby clamp the sheets of paper P between the head portion 4 and the clincher unit 2; and a raise/lower drive mechanism 33 configured to drive the operation member 13.

According to the above structure, when the operation member is driven by the raise/lower drive mechanism, the operation member is engaged with the driver to drive it, thereby moving the leading staple existing within the strike-out portion to the holding portion; and also, the operation member is engaged with the head portion to move it toward the clincher unit, thereby clamping the sheets of paper between the head portion and clincher unit. This allows the operation member to carry out an operation to separate the leading staple from the connected staples and store it into the holding portion and an operation to drive the head portion to thereby clamp the sheets of paper, whereby the structure of the paper clamp mechanism can be simplified.

In the above structure, wherein the operation member may include: an operation plate 13 slidable along the strike-out portion 17 and engageable respectively with the driver 11 and the head portion 4. The raise/lower drive mechanism 33 may include: a cam 38 operatively connectable to an electric motor 34 of the drive portion 5; and an operation link 39 capable of being swung by the cam 38. A leading end of the operation link 39 may be engageable with the operation plate 13.

In the above structure, the drive portion may include: a main cam 48 formed integrally with said cam 38; and a main link 49 capable of being swung by the main cam 48. A leading end of the main link 49 may be engaged with the driver 11.

According to the above structure, the operation member is constituted of an operation plate which can be slid along the strike-out portion and, in the sliding operation thereof, can be engaged with the driver and head portion; the raise/lower drive mechanism includes a cam operatively connected to the electric motor of the drive portion, and an operation link capable of being swung by the cam; and, the leading end of the operation link can be engaged with the operation plate slidable along the strike-out portion. Thanks to this, the cam/link mechanism for driving the operation plate can be combined with a well known cam/link mechanism for driving a driver, whereby the whole structure of the paper clamp mechanism can be designed compact.

In the above structure, the operation plate 13 may be configured to engage with the head portion 4 after engaging with the driver 11.

According to the above structure, since the operation plate is engaged with the head portion after it is engaged with the driver, due to the movement of the operation plate in one direction, the storage of the leading stapler into the holding portion by the driver and the raising and lowering operations of the head portion can be carried out at different timings.

In the above structure, the operation plate 13 may comprise a guide plate 13*b* configured to guide two sides of the staple existing within the strike-out portion 7.

According to the above structure, since the operation plate is a guide plate so formed as to guide the two sides of a staple existing within the strike-out portion, when the driver separates the leading staple from other staples and moves it to the holding portion, the staple can be guided by the guide plate and thus can be positively stored into the holding portion.

Moreover, in the above structure, the head portion 4 may include: a front plate portion 12*b*; and a rear plate 19 arranged to be parallel with the front plate portion 12*b*. A strike-out portion 7 for slidably supporting the driver 11 may be formed by the front plate portion 12*b* and the rear plate 19. The front plate portion 12*b* and the rear plate 19 may be configured move integrally with each other and may also be relatively movable with respect to the staple storage portion 3 in a first direction in which the driver 11 slides.

In the above structure, the head portion 4 may include a head member 12 formed by a side plate portion 12*a* and said front plate portion 12*b*. The rear plate 19 may be fixed to the head member 12.

In the above structure, a holding portion 20 configured to hold a single piece of the staple s may be provided within the strike-out portion 7.

In the above structure, the electric stapler may further include a staple support member 28. The staples SS stored in the staple storage portion 3 may be fed toward the strike-out portion 7 in a second direction which is perpendicular to the first direction. The staple support member 28 may be supported to rotate around a shaft 100 extending in a third direction which is perpendicular to both the first direction and the second direction and the support member 28 is capable of entering/exiting the holding portion 20. The shaft 100 of the staple support member 28 may be fixed to the head member 12. The staple support member 28 may be relatively movable with respect to the staple storage portion 3 in the first direction, integrally with the front plate portion 12*b* and the rear plate 19.

In the above structure, the electric stapler may further includes: a guide portion 14 formed in one of the head member 12 and a side of the staple storage portion 3; and a fixed shaft 15 engaged with the guide portion 14 and formed in the other of the head member 12 and the side of the staple storage portion 3.

Other aspects and advantages of the invention will be apparent from the following description and the appended claims.

DETAILED DESCRIPTION OF THE EXEMPLARY EMBODIMENTS

A vertically separated type saddle stitching stapler according to an exemplary embodiment of the invention is described with reference to FIGS. 1(*a*), 1(*b*) and 2.

Figure 1A:
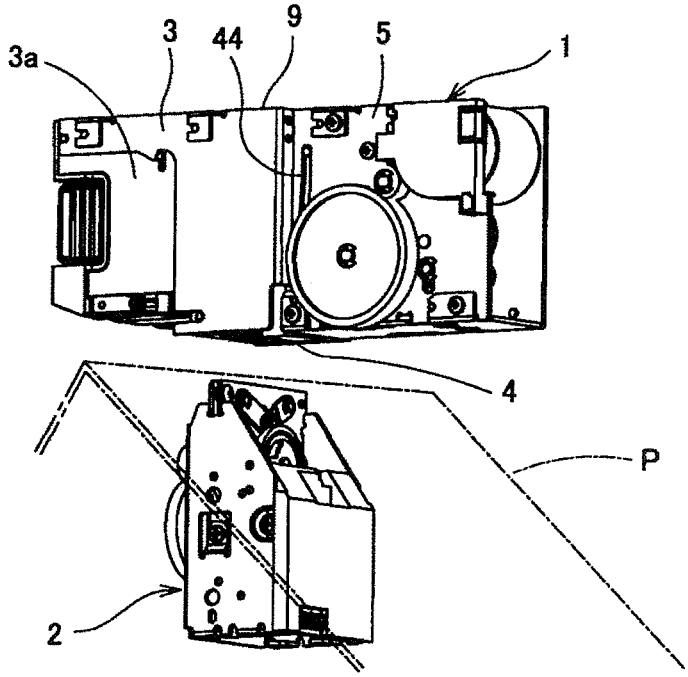
FIG. 1A is a perspective view of a basic structure of a stapler of a vertically separated type, showing a standby time.
Figure 1B:
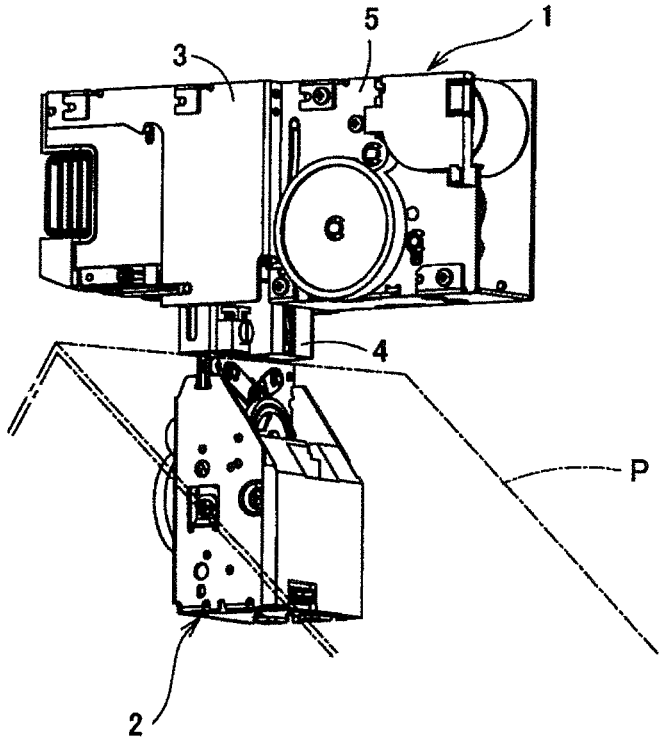
FIG. 1B is a perspective view of the stapler, showing a binding time.

As shown in FIGS. 1(*a*) and 1(*b*), the stapler of a vertically separated type includes a driver unit 1 and a clincher unit 2 which are separated from each other in the vertical direction, while papers P supplied to between the driver unit 1 and clincher unit 2 can be bound with a staple.

The driver unit 1 includes a staple storage portion 3 for storing a large number of connected staples, a head portion 4 for striking out staples, and a drive portion 5 for driving a driver which is slidably provided in the head portion 4. The clincher unit 2 includes a movable clincher for bending a staple struck out by the driver and a drive mechanism for driving the movable clincher.

Figure 2:
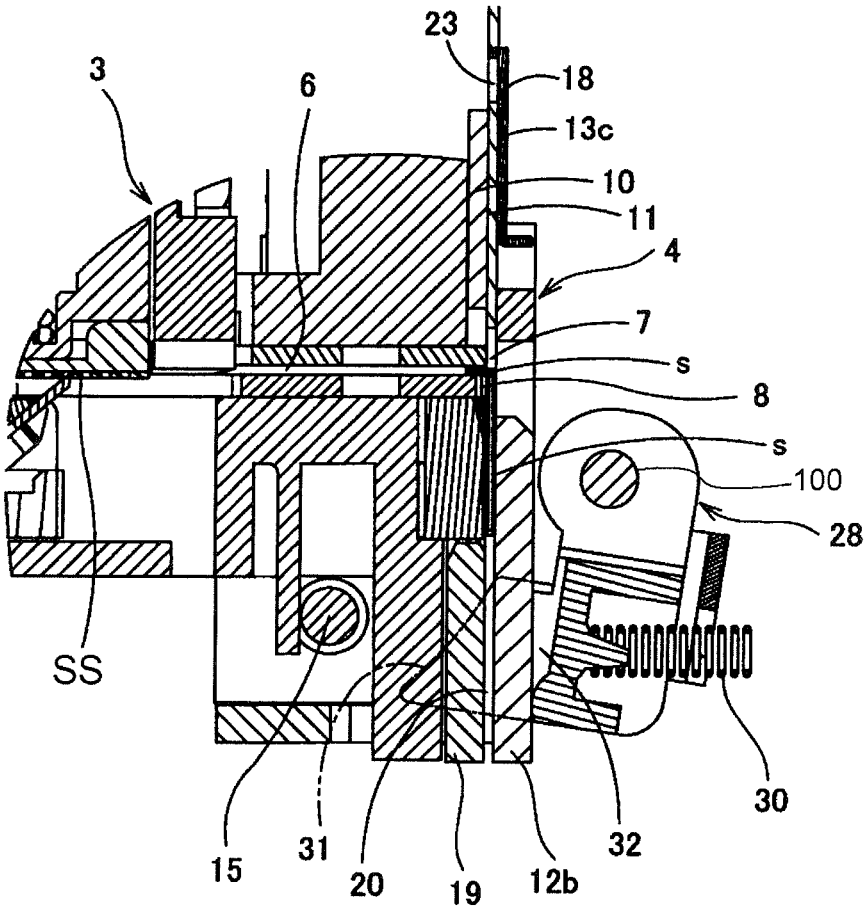
FIG. 2 is a section view of main portions of a head portion of the stapler.
Figure 2:
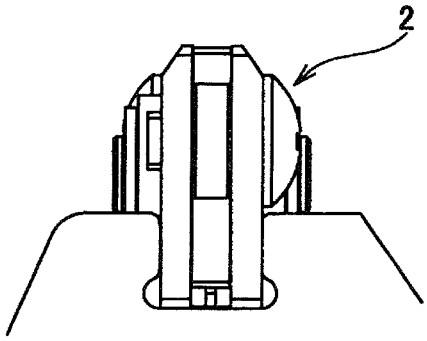

In the staple storage portion 3 of the driver unit 1, there is stored a staple cartridge 3*a*. In the staple cartridge 3*a*, for example, there are stored sheet staples (constituted of straight-shaped staples which are connected together in a sheet manner) in such a manner that they are laid on top of each other. Also, in the staple storage portion 3, as shown in FIG. 2, there is formed a supply passage 6 for the sheet staples SS fed out from the staple cartridge, while the end portion of the supply passage 6 is opened in a strike-out portion 7 (which will be discussed later) formed in the head portion 4. Also, on the end portion of the supply passage 6 of the staple storage portion 3, there is provided a staple bending base member 8 which is disposed at a position corresponding to the lower portion of a forming plate which will be discussed later.

The head portion 4 includes a strike-out portion 7 opened in the staple storage portion 3, a forming plate 10 for forming staples supplied from the staple storage portion 3 to the strike-out portion 7 respectively into U-shaped staples, and a driver 11 for striking out the leading one of the thus formed staples. The driver 11 is provided in such a manner that it can be slid along the strike-out portion 7. The forming plate 10 is disposed in such a manner that it can be slid in the vertical direction integrally with the driver 11 in front of the strike-out portion 7. In the lower end of the forming plate 10, there is formed a recessed portion (not shown) and, in the sliding operation of the forming plate, the two leg portions of the recessed portion are used to press the two sides of the straight-shaped staple to thereby form the staple into a U-shaped staple.

Next, the staple storage portion 3 and drive portion 5 are formed integrally with each other within a housing 9, whereas the head portion 4 is separated from them and can be raised or lowered with respect to the housing 9.

Figure 3:
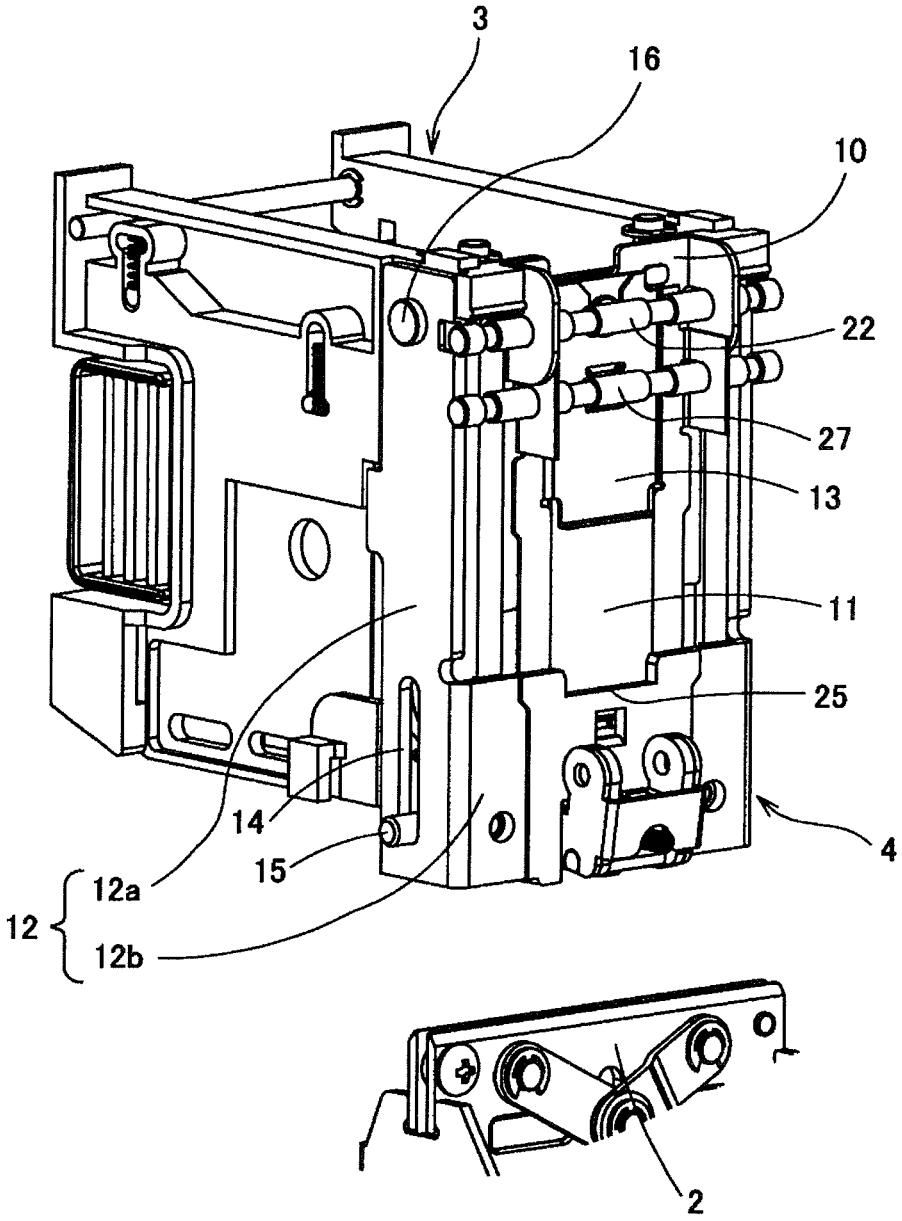
FIG. 3 is a perspective view of the stapler, showing a state where the head portion is slidably held by a stapler storage portion.

The head portion 4 is structured such that, as shown in FIG. 3, on the front side upper portion of a head member 12 mainly including two side plate portions 12*a* respectively formed on both sides thereof and a front plate portion 12*b* formed on the front side lower portion thereof, the forming plate 10 and driver 11 are so arranged as to be slidable in the vertical direction (first direction), and an operation plate (operation member) 13 (which will be discussed later) is so disposed in the front side central portion of the head portion 4 as to be slidable in the vertical direction.

Figure 4:
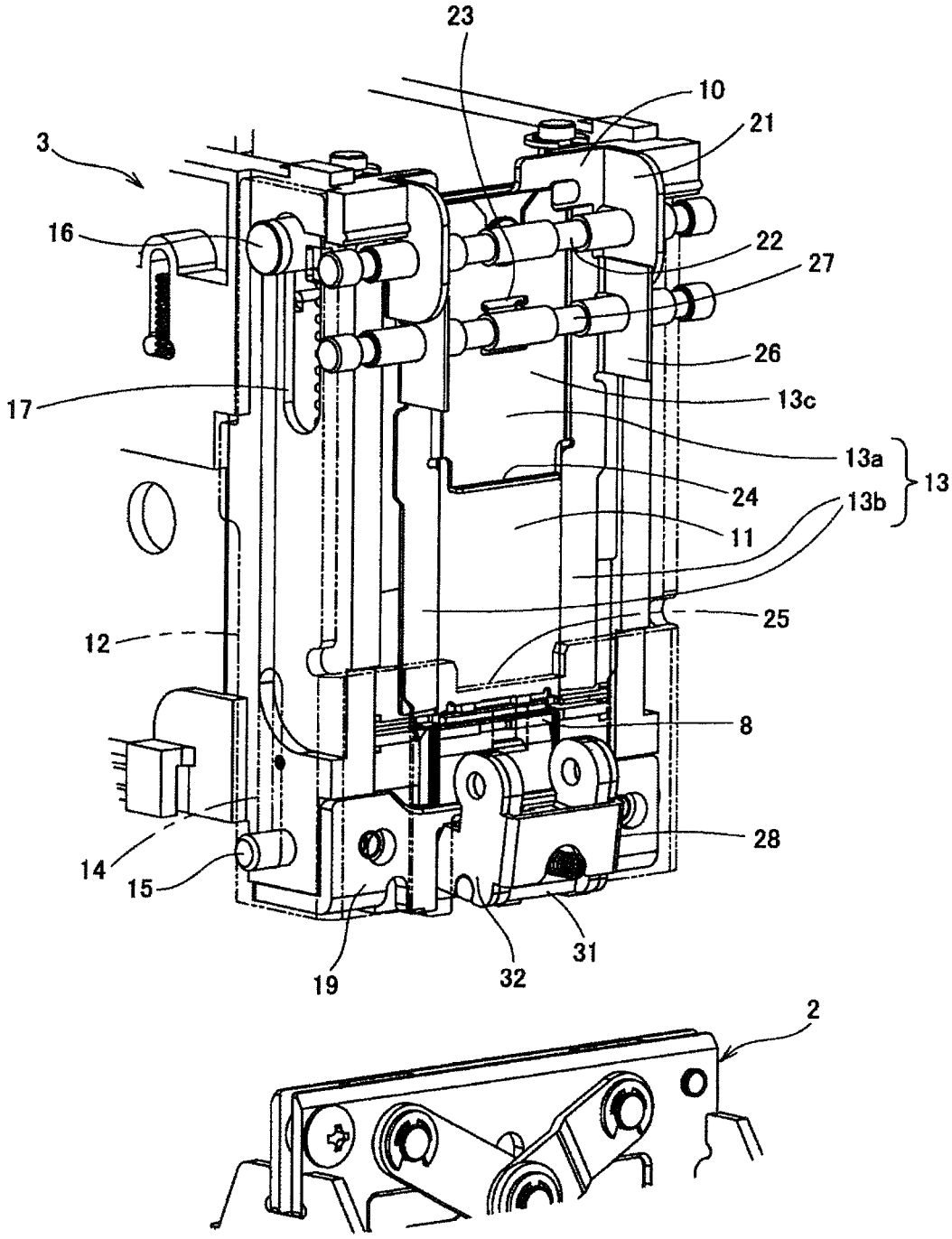
FIG. 4 is an enlarged view of a portion of FIG. 3.

As shown in FIGS. 3 and 4, in the side plate portion 12*a* of the head member 12, there is formed a guide groove 14 (guide portion 14) long in the vertical direction; and, into the guide groove 14, there is engaged a fixed shaft 15 which is fixed to a side of the staple storage portion 3. Also, a shaft 16 is fixed to the upper portion of the side plate portion 12*a* and is also engaged into a guide groove 17 which is so formed in the staple storage portion 3 as to extend in the vertical direction. Owing to this structure, the head member 12 is able to slide in the vertical direction and can also be raised or lowered with respect to the staple storage portion 3 and drive portion 5. Further, although the guide portion 14 is provided on the head member 12 and the fixed shaft 15 is provided on the side of the staple storage portion 3 in this exemplary embodiment, the head member 12 can be relatively movable with respect to the staple storage portion 3 even when the guide portion 14 is provided on the side of the staple storage portion 3 and the fixed shaft 15 is provided on the head member 12.

On the inner lower portion of the side plate portion 12*a* of the head member 12, as shown in FIG. 2, there are arranged a front plate portion 12*b* and a rear plate 19 parallel to each other and, between them, there is interposed the strike-out portion 7 for slidingly driving the driver 11 and operation plate 13. The rear plate 19 is fixed to the head member 12 and the rear plate 19 is movable integrally with the head member 12. The front plate portion 12*b* is so disposed as to face the open end of the staple supply passage 6. The staple supply passage 6 through which staples (SS) are fed from the staple storage portion 3 to the strike-out portion 7 extends in a front-rear direction (which is a second direction perpendicular to the first direction). On the upper portion of the strike-out portion 7, there are disposed the driver 11 and forming plate 10 in such a manner that they are able to slide in the vertical direction. On the lower portion of the strike-out portion 7, there is disposed a holding portion 20 having such a space as can hold a single piece of staple therein.

On the head portion 4, besides the above-mentioned forming plate 10 and driver 11, there is slidably disposed the operation plate 13.

On two bent portions 21 which are respectively formed on both sides of the upper portion of the forming plate 10, there are first drive shafts 22 respectively.

The operation plate 13, as shown in FIG. 4, includes an upper plate 13*a* and two guide plates 13*b* respectively projected downwardly from the two sides of the upper plate 13*a*. And, the central portion of the upper plate 13*a* projects forwardly, and the central portion of this projecting portion 13*c* is cut and raised to form a projecting piece 18 (see FIG. 2) which projects backwardly of the operation plate 13, while the projecting piece 18 is inserted into an elongated hole 23 formed in the driver 11. On the lower end of the projecting portion 13*c*, there is provided an engaging piece 24 which projects forwardly of the operation plate 13, while the engaging piece 24 can be engaged with a receiving portion 25 which is formed in the central portion of the upper portion of the front plate portion 12*b* of the head member 12. The two guide plates 13*b* are structured such that they can slide along the two sides of the strike-out portion 7 to guide the outer surfaces (two outsides) of the leg portions s1 of formed staple s (see FIGS. 2 and 14). The driver 11 is disposed such that it is held between the two guide plates 13*b* and is flush with these guide plates 13*b*. Also, the two side portions of the upper plate 13*a* are bent forwardly and, on and across these bent portions 26, there is mounted a second drive shaft 27. The first drive shaft 22 and second drive shaft 27 are structured such that they can slide along the elongated hole 29 of the housing 9.

Here, the operation plate 13 is structured such that, when it slides downwardly, after the projecting piece 18 is engaged into the elongated hole 23 of the driver 11 to slide the driver 11 downwardly, the engaging piece 24 is engaged with the receiving portion 25 of the head portion 4 to slide the head portion 4 downwardly.

Also, on the front portion of the front plate portion 12*b*, there is disposed a staple support member 28; and, the staple support member 28 is energized by a spring 30 in such a manner that it can be turned toward the back surface of the front plate portion 12*b*. The staple support member 28 is rotatable around a rotating shaft 100. The rotating shaft 100 extends in a right-left direction (a third direction, which is perpendicular to both the first direction and the second direction). The rotating shaft 100 is fixed to the head member 12. The staple support member 12 is capable to entering/exiting the holding portion 20 by rotating. In the staple support member 28, there are formed a crown support 31 for supporting the crown portion of a staple struck out and an inside support 32 (see FIG. 14) for supporting the inside of the leg portions of the staple s.

Figure 5:
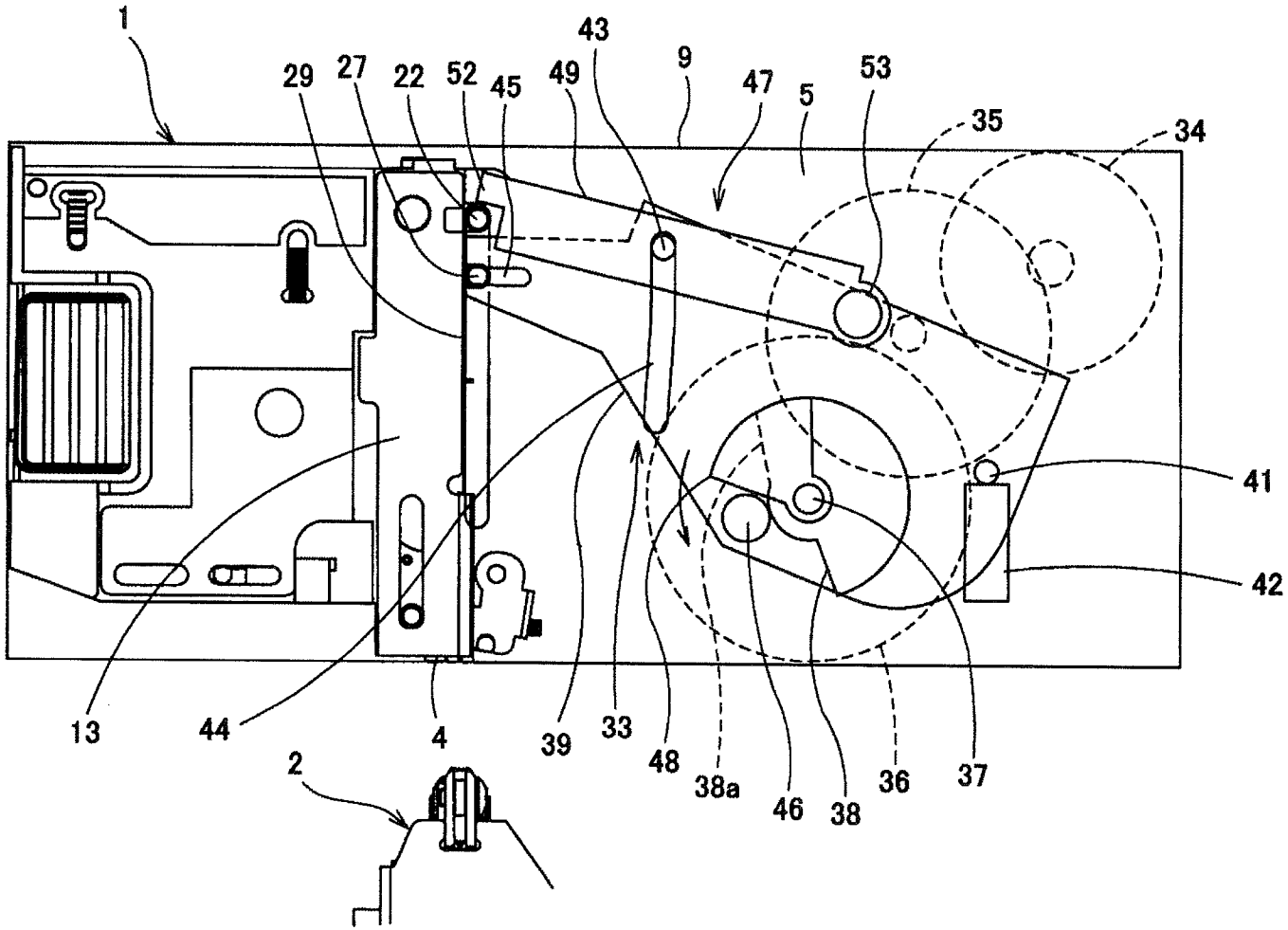
FIG. 5 is a side view of a raise/lower drive mechanism and a driver drive mechanism.

Next, in the head portion 4 and drive portion 5, there is provided a head raise/lower mechanism which is used to raise and lower only the head portion 4. Specifically, the head raise/lower mechanism can lower the head portion 4 to thereby clamp the sheets of paper P (see FIG. 1) interposed between the head portion 4 and clincher unit 2; and, the raise/lower mechanism can also separate the leading staple s, which has been supplied from the supply passage 6 to the strike-out portion 7, from the next staple and move the leading staple s to the holding portion 20. And, as shown in FIGS. 4 and 5, the head raise/lower mechanism includes the above-mentioned operation plate 13 for operating the driver 11 and head portion 4, and a raise/lower drive mechanism 33 for driving the operation plate 13.

The raise/lower drive mechanism 33, which is provided in the drive portion 5, includes a drive gear 36 operatively connected to an electric motor 34 through a mid-gear 35, an operation link cam 38 formed in the periphery of the shaft 37 of the drive gear 36, and an operation link 39 so formed as to be engageable with the operation link cam 38. The operation link cam 38 is formed to have a substantially semicircular shape. The operation link 39 is formed such that its leading end side is narrow and the opposite side is wide; and, on the end portion of the wide side of the operation link 39, there is provided a rotation shaft 41. On the rotation shaft 41, there is mounted a paper thickness adjust spring 42. Also, to such portion of the operation link 39 as exists rather near to the narrow side thereof than the middle portion thereof, there is fixed a guide shaft 43. The guide shaft 43 is structured such that it can slide in the vertical direction along a guide groove 44 formed in the housing 9 of the drive portion 5. In the leading end of the operation link 39, there is formed an engaging groove 45 which is engaged with the second drive shaft 27. Further, on the lower portion of the wide side of the operation link 39, there is provided an operation link follower 46. The operation link follower 46 can be engaged with the operation link cam 38.

In the drive portion 5, together with the raise/lower drive mechanism 33 of the operation plate 13, there is provided a driver drive mechanism 47 which is used to drive the driver 11 and forming plate 10. The driver drive mechanism 47 includes a main cam 48 formed in the periphery of the shaft 37 of the drive gear 36 and a main link 49 so formed as to be engageable with the main cam 48. The main cam 48 is formed to have a fan shape and is disposed to be coaxial with the operation link cam 38; the main cam 48 includes a rotation shaft (guide shaft 43) provided in the middle portion thereof; and, the main cam 48 is able to slide in the vertical direction along the guide groove 44. The leading end 52 of the main link 49 is engaged with the first drive shaft 22. Further, on the opposite end of the main link 49, there is provided a main link follower 53. The main link follower 53 is formed such that it can be engaged with the main cam 48.

Figure 6:
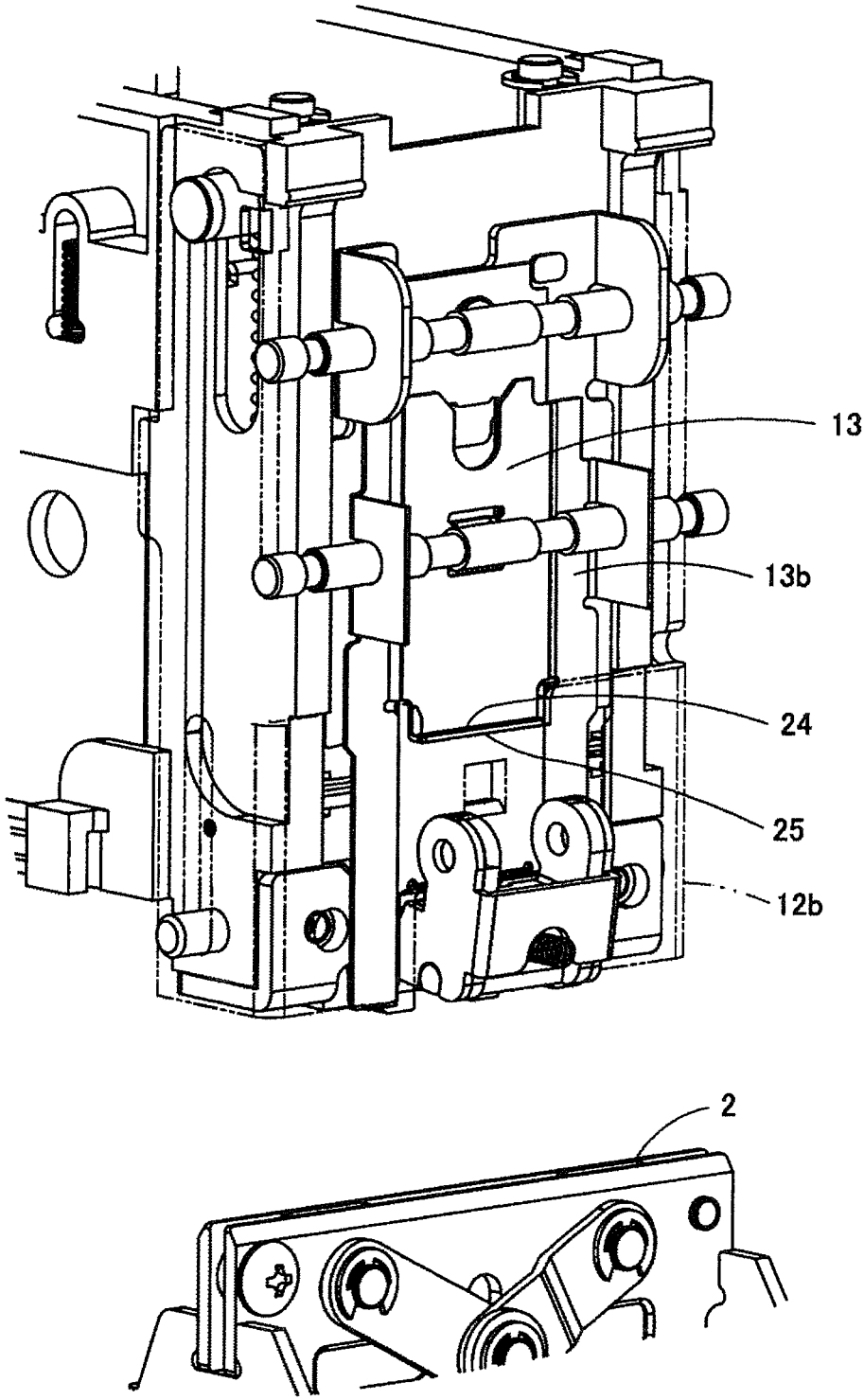
FIG. 6 is a perspective view of the head portion, showing an initial state of an operation plate included in the head portion.
Figure 7:
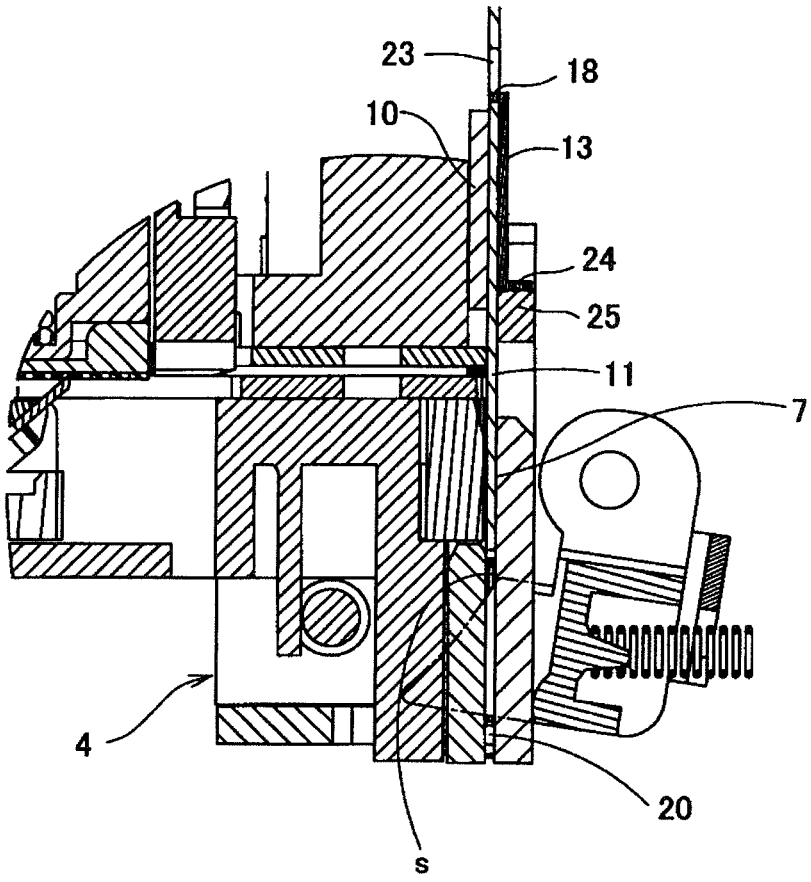
FIG. 7 is a section view of the head portion, showing the initial state of the operation plate.
Figure 7:
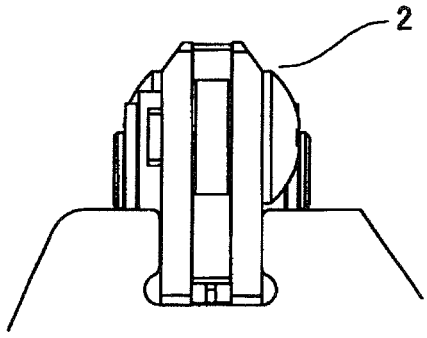
Figure 8:
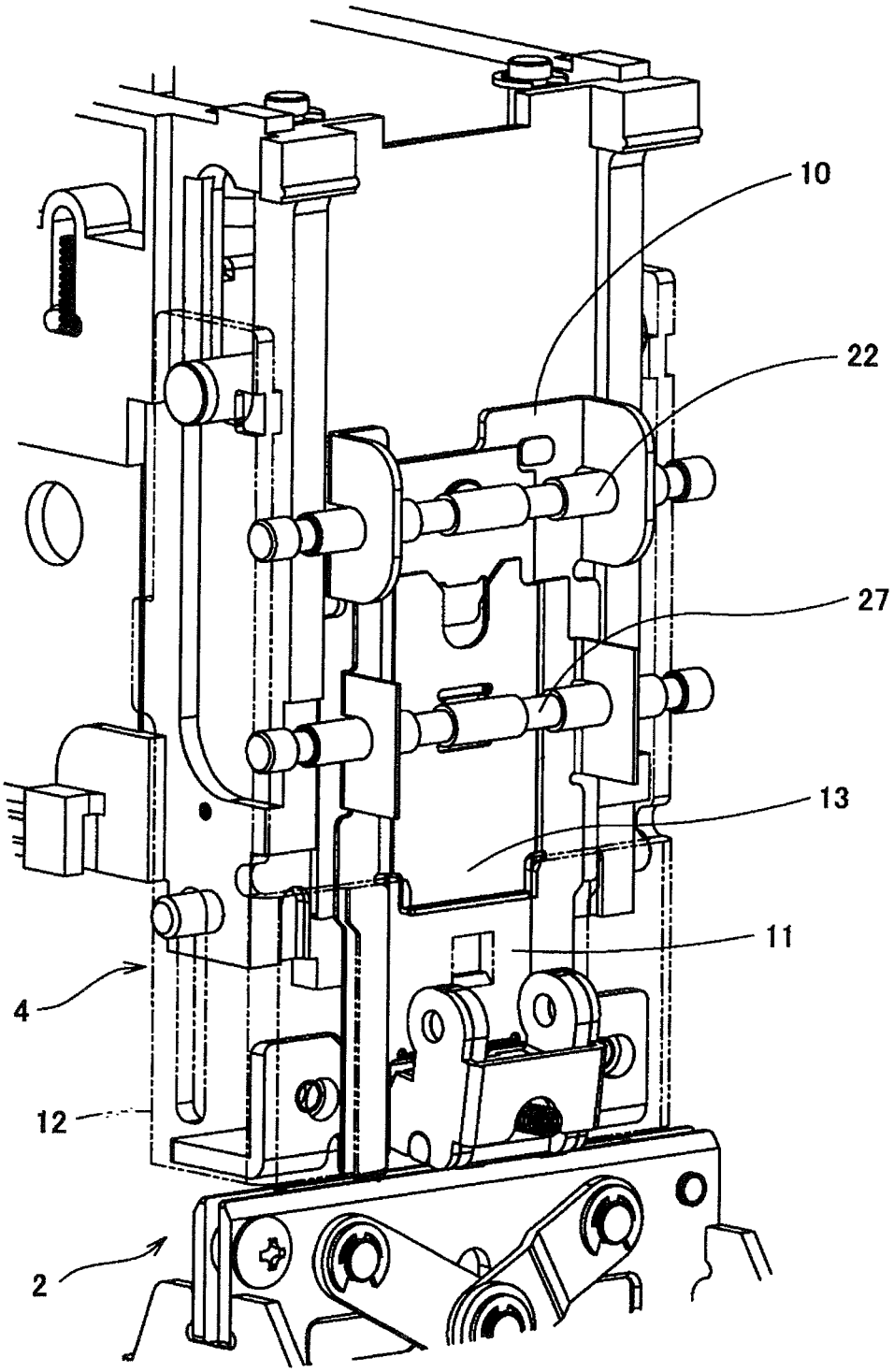
FIG. 8 is a perspective view of the head portion, showing a clamping state of the operation plate.
Figure 9:
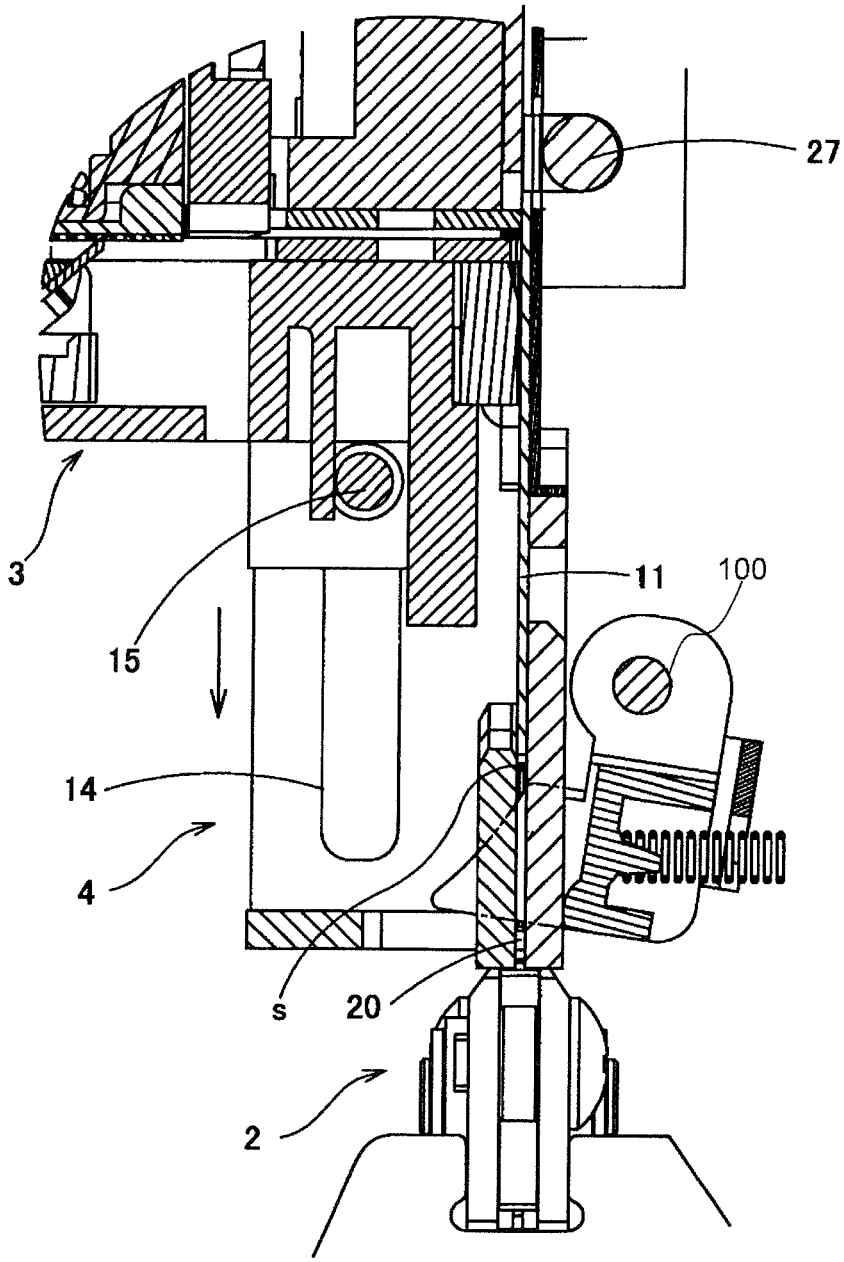
FIG. 9 is a section view of the head portion, showing the clamping state of the operation plate.
Figure 12:
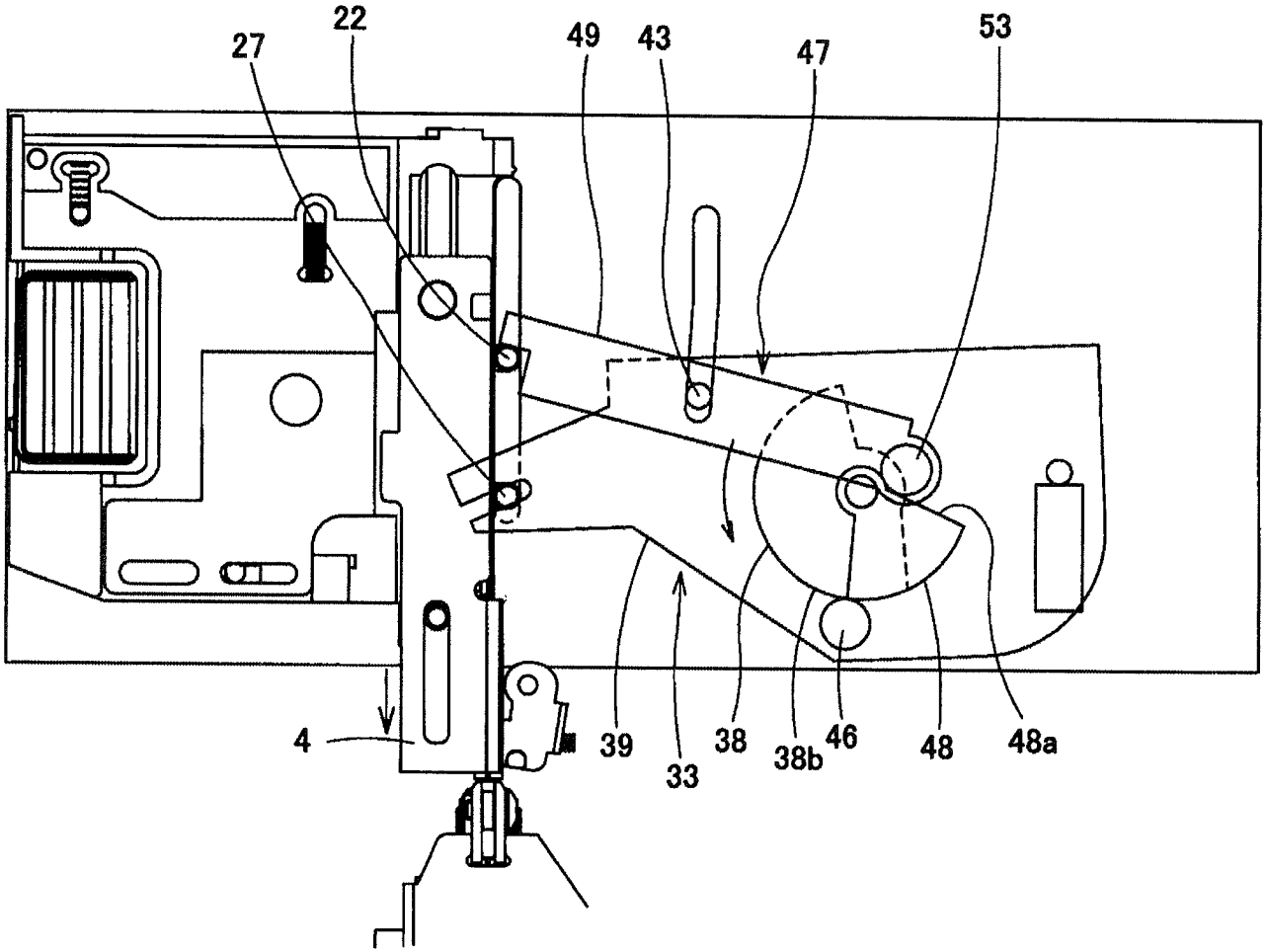
FIG. 12 is a side view of the raise/lower drive mechanism and driver drive mechanism, showing the operating states thereof, with gears and the like omitted.
Figure 14:
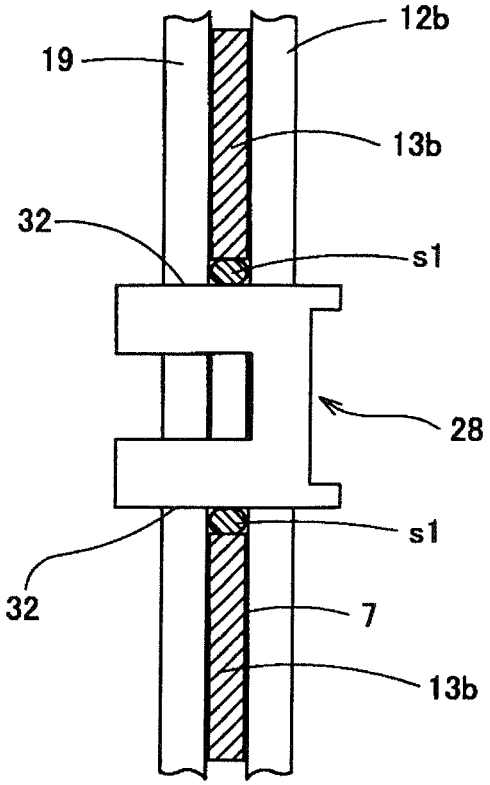
FIG. 14 is an explanatory view to show how to support a staple.

Here, description will be given of the operation mode of the above-mentioned paper clamp mechanism. Firstly, in the standby state of the paper clamp mechanism, the operation link 39 and main link 49 are arranged as shown in FIG. 5. At the then time, as shown in FIGS. 2 and 4, the driver 11, forming plate 10 and guide plate 13*b* are respectively held at their top dead centers. Next, after the sheets of paper P is inserted into between the driver unit 1 and clincher unit 2, when the switch of the electric motor 34 is turned on, the drive gear 36 is rotated and, simultaneously with the rotation of the electric motor 34, the operation cam 38 and main cam 48 are also rotated. In this case, firstly, as shown in FIG. 5, since the straight line portion 38*a* of the operation link cam 38 is engaged with the operation link follower 46 of the operation link 39 to thereby press it downwardly, the operation link 39 is swung downwardly about the rotation shaft 41 and the leading end of the operation link 39 presses down the second drive shaft 27, whereby the operation plate 13 is lowered. During the lowering movement of the operation plate 13, as shown in FIGS. 6 and 7, the projecting piece 18 of the operation plate 13 is engaged with the lower edge of the elongated hole 23 of the driver 11, whereby the driver 11 and forming plate 10 are moved downward respectively. Thus, the driver 11 strikes out the staple s already supplied to the strike-out portion 7 to separate it from the connected staples, and moves the staple s down to the holding portion 20. As shown in FIG. 14, the outer surfaces of the leg portions of the staple existing within the strike-out portion 7 are respectively guided by the guide plates 13*b* of the operation plate 13. When the staple is moved down to the holding portion 20, the engaging piece 24 on the central portion of the operation plate 13 is engaged with the receiving portion 25 of the front plate portion 12*b* to thereby press down the front plate portion 12*b*. That is, the head member 12 (the side plate portions 12*a* and the front plate portion 12*b*), the rear plate 19, the staple support member 28 are integrally move in the down direction (move with respect to the staple storing portion 3 in the first direction). Due to this, as shown in FIGS. 8 and 9, the head portion 4 moves down and clamps the sheets of paper inserted into between the head portion 4 and clincher unit 2. In this manner, when the head portion 4 is moved down to the bottom dead center by the raise/lower drive mechanism 33, further as shown in FIG. 12 as well, the operation link follower 46 moves along the arc-shaped outer peripheral surface 38*b*, whereby the operation link 39 is held in the state.

Figure 10:
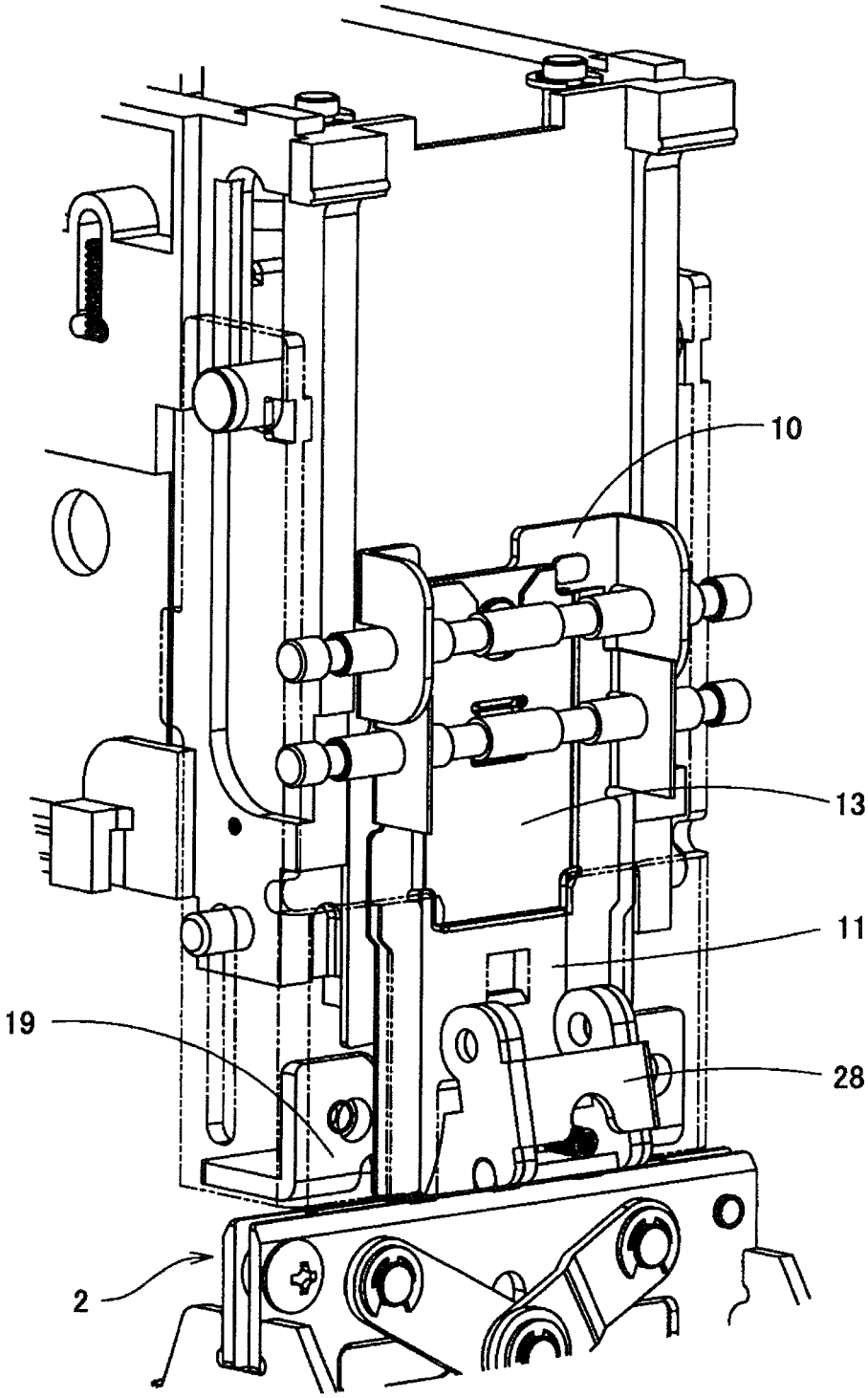
FIG. 10 is a perspective view of the head portion, showing a binding completion state of the operation plate.
Figure 11:
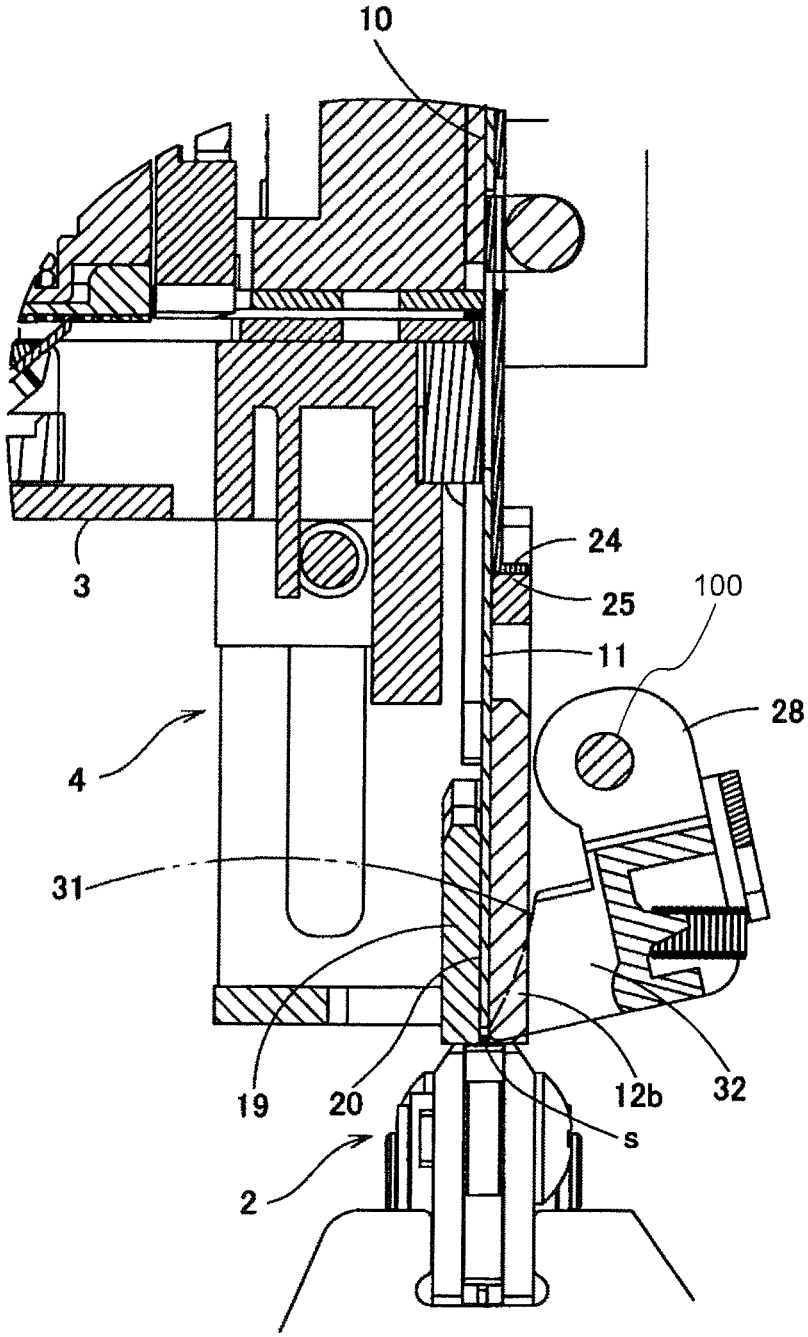
FIG. 11 is a section view of the head portion, showing the binding completion state of the operation plate.
Figure 13:
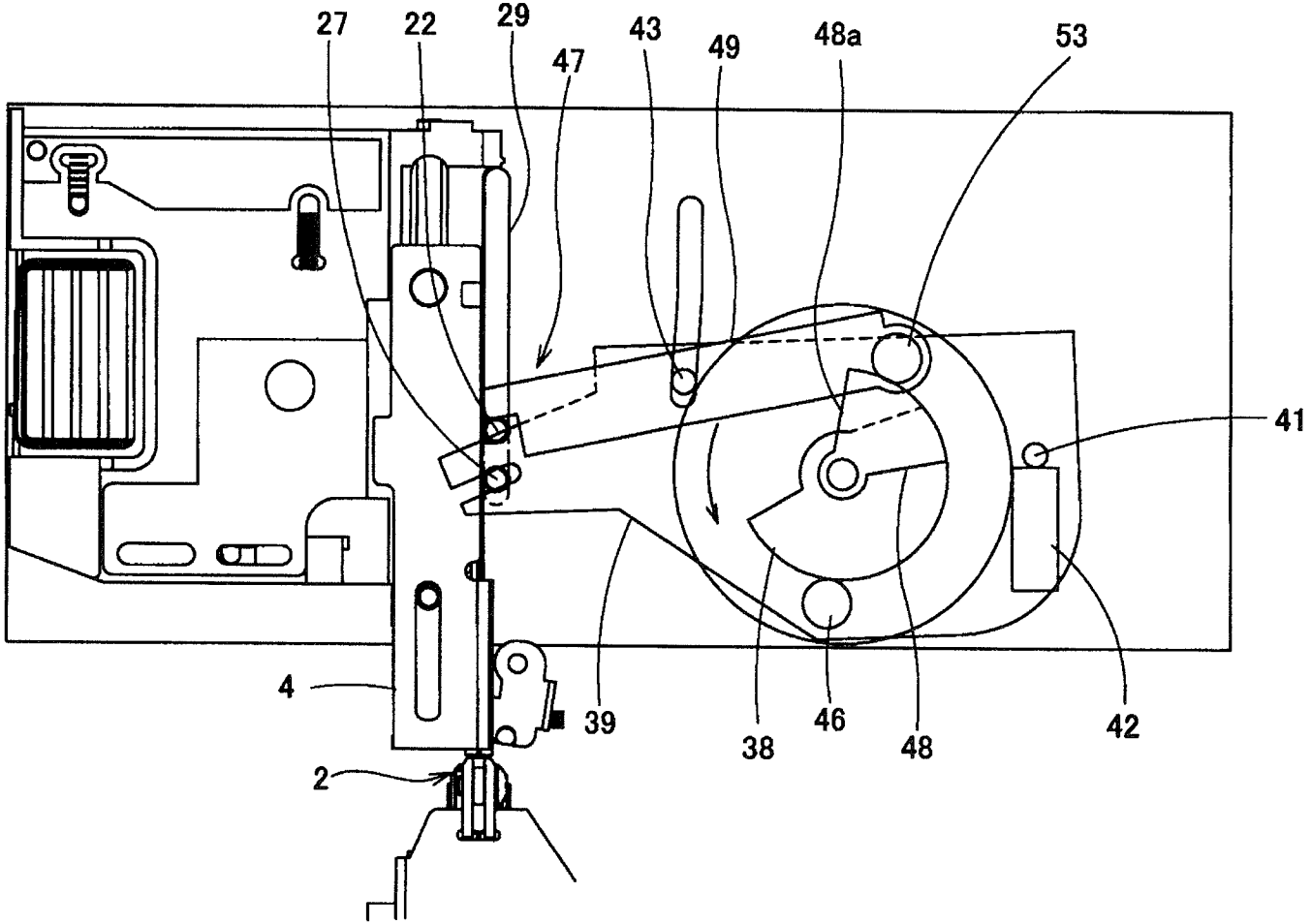
FIG. 13 is a side view of the raise/lower drive mechanism and driver drive mechanism, showing the states of completion of the binding operations thereof, with gears and the like omitted.

Following the above operation, the driver drive mechanism 47 is operated. That is, as shown in FIG. 13, the main link follower 53 is engaged with the straight line portion 48*a* of the main cam 48 which has rotated together with the operation link cam 38, whereby the main link follower 53 is pushed up. Since the rotation shaft 43 remains fixed, the main link 49 rotates about the rotation shaft 43 and the leading end side of the main link 49 moves down to press down the first drive shaft 22, whereby, as shown in FIGS. 10 and 11, the driver 11 and forming plate 10 are driven downward respectively. Thus, the staple s held in the holding portion 20 is struck out downward from the head portion 4 and is penetrated through the sheets of paper. At the then time, as shown in FIG. 14, the front and rear portions of the two leg portions s1 of the staple are supported by the front plate portion 12*b* of the holding portion 20 and rear plate 19, the outer surfaces of the two leg portions s1 are guided by the guide plates 13*b* respectively, and further the inner surfaces of the two leg portions s1 are supported by the inside support 32 of the staple support member 28. Also, as shown in FIG. 11, since the crown portion of the staple s is supported by the crown support 31 of the staple support member 28, the staple s is sure to penetrate through the sheets of paper. And, a movable clincher disposed on the upper end of the clincher unit 2 is operated by the drive mechanism of the clincher unit 2 to bend the legs of the staple s, thereby binding the sheets of paper.

Here, in the case that the bundle of the sheets of paper is thick, since the leading end of the main link 49 stops at a position higher than a position when a load is zero, the amount of the stroke of the main link 49 varies. The varying stroke amount can be adjusted by the paper thickness adjust spring 42.

Since, after completion of the binding operation, the operation link follower 46 and main link follower 53 are removed from the operation link cam 38 and main cam 48, the operation link 39 and main link 49 become free and thus they are moved and returned to their respective standby positions by a cam/link mechanism (not shown) or the like, thereby ending one cycle of a series of binding operations.

As described above, since, in the binding operation, only the head portion 4 is moved from the driver unit 1 toward the clincher unit 2 by the head raise/lower mechanism to thereby clamp the sheets of paper, when compared with a case in which the head portion 4 is moved together with the staple storage portion 3, the load necessary for the movement is small, whereby the size of the paper clamp mechanism can be reduced and also the speed of the binding operation thereof can be increased. Here, as the number of staples stored within the staple storage portion 3 increases or decreases, the weight of the staple storage portion 3 increases or decreases. However, according to the present embodiment, since the staple storage portion 3 variable in weight is not moved but only the leading staple is separated from the remaining staples and only the head portion 4 invariable in weight is moved, the center of gravity of the paper clamp mechanism is constant and the driver 11 will never be inclined, whereby the center position of paper binding by the staple s can be stabilized. Therefore, proper paper binding can always be secured.

Also, when the operation plate 13 is driven by the raise/lower drive mechanism 33, the operation plate 13 is engaged with the driver 11 to drive the driver 11, thereby moving the leading staple existing within the strike-out portion 7 to the holding portion 20; and also, the operation plate 13 is engaged with the head portion 4 to move the head portion 4 toward the clincher unit 2, thereby clamping the sheets of paper between the head portion 4 and clincher unit 2. This makes it possible for the operation plate 13 to carry out two operations: one is to separate the leading staple from the connected staples and hold it into the holding portion 20; and, the other is to drive the head portion 4 to clamp the sheets of paper. This can simplify the structure of the paper clamp mechanism.

Further, the operation plate 13 is constituted of the operation plate 13 which can slide along the strike-out portion 7 and, when sliding, can be engaged with the driver 1 and head portion 4 respectively; the raise/lower drive mechanism 33 includes the operation link cam 38 operatively connectable to the electric motor 34 of the drive portion 5, and the operation link 39 which can be swung by the operation link cam 38; and, the leading end of the operation link 39 can be engaged with the operation plate 13 slidable along the strike-out portion 7. Owing to this, the cam/link mechanism for driving the operation plate 13 can be combined with a known cam/link mechanism for driving the driver 11, thereby being able to reduce the size of the structure of the whole of the paper clamp mechanism.

Also, since the operation plate 13 is structured such that it can be engaged with the head portion 4 after it is engaged with the driver 11, by moving the operation plate 13 in one direction, the operation to hold the leading staple into the holding portion 20 by the driver 11 and the operation to raise or lower the head portion 4 can be carried out at different timings.

Further, since the operation plate 13 includes the two guide plates 13*b* structured such that they can guide the two sides of the staple existing within the strike-out portion 7, when the driver 11 separates the leading staple from the other staples and moves it up to the holding portion 20, the leading staple can be guided by the guide plates 13*b* and can be stored into the holding portion 20 positively.

Here, the operation member is not limited to plate-shaped means. That is, as the operation member, there can be employed any other means, provided that it can be engaged with the driver to drive it to thereby move the leading staple existing within the strike-out portion to the holding portion and also can be engaged with the head portion to move it toward the clincher unit to thereby clamp the sheets of paper between the head portion and clincher unit.

DESCRIPTION OF REFERENCE NUMERALS AND SIGNS

P: Sheets of paper
1: Driver unit
2: Clincher unit
3: Staple storage portion
4: Head portion
5: Drive portion
7: Strike-out portion
11: Driver
13: Operation plate (operation member)
20: Holding portion
33: Raise/lower drive mechanism
38: Operation link cam
39: Operation link
48: Main cam
49: Main link

What is claimed is:

1. An electric stapler comprising:

a driver unit including a driver for striking out a staple to be penetrated through sheets of paper; and a clincher unit including a clincher for bending leg portions of the staple penetrated through the sheets of paper, wherein the driver unit includes:

a staple storage portion for storing therein a large number of connected staples, a head portion for striking out the staple, and a drive portion configured to drive said driver provided slidably in the head portion, wherein the staple storage portion, the head portion, and the drive portion are aligned horizontally with respect to a driving direction of the driver such that the head portion is disposed between the staple storage portion and the drive portion in the horizontal direction;

a head raise/lower mechanism configured to relatively move the head portion with respect to the staple storage portion toward the clincher unit to clamp the sheets of paper; and an operation member including an operation plate slidable along a strike-out portion and engageable respectively with the driver and the head portion, wherein the head raise/lower mechanism includes, an operation cam operatively connectable to an electric motor of the drive portion; and an operation link capable of being swung by the operation cam, a leading end of the operation link being engageable with the operation plate of the operation member, wherein the drive portion includes, a main cam formed integrally with said operation cam; and a main link capable of being swung by the main cam, a leading end of the main link being engaged with the driver, and wherein a guide shaft is fixed to the operation link and configured to slide in a vertical direction along a guide groove formed in the driver, and the main link rotates about the guide shaft.

2. The electric stapler according to claim 1, wherein the head portion includes:

the strike-out portion formed to open in the staple storage portion, wherein said driver is part of the head portion and is configured to strike out a leading staple supplied from the staple storage portion to the strike-out portion; and a staple holding portion formed on a strike-out side of the strike-out portion, and wherein the head raise/lower mechanism includes:

the operation member engageable with the driver so that the driver moves the leading staple existing within the strike-out portion to the holding portion and also engageable with the head portion to move the head portion toward the clincher unit to thereby clamp the sheets of paper between the head portion and the clincher unit.

3. The electric stapler according to claim 1, wherein the operation plate is configured to engage with the head portion after engaging with the driver.

4. The electric stapler according to claim 1, wherein the operation plate comprises a guide plate configured to guide two sides of the staple existing within the strike-out portion.

5. The electric stapler according to claim 1, wherein the head portion includes:

a front plate portion; and a rear plate arranged to be parallel with the front plate portion, wherein the strike-out portion for slidably supporting the driver is formed by the front plate portion and the rear plate, and wherein the front plate portion and the rear plate are configured to move integrally with each other and are also relatively movable with respect to the staple storage portion in a first direction in which the driver slides.

6. The electric stapler according to claim 5, wherein the head portion includes a head member formed by a side plate portion and said front plate portion, and the rear plate is fixed to the head member.

7. The electric stapler according to claim 6, wherein a holding portion configured to hold a single piece of the staple is provided within the strike-out portion.

8. The electric stapler according to claim 7, further comprising a staple support member, wherein the staples stored in the staple storage portion are fed toward the strike-out portion in a second direction which is perpendicular to the first direction, wherein the staple support member is supported to rotate around a shaft extending in a third direction which is perpendicular to both the first direction and the second direction and the support member is capable of entering/exiting the holding portion, and wherein the shaft of the staple support member is fixed to the head member, and the staple support member is relatively movable with respect to the staple storage portion in the first direction, integrally with the front plate portion and the rear plate.

9. The electric stapler according to claim 8, further comprising:

a guide portion formed in one of the head member and a side of the staple storage portion; and a fixed shaft engaged with the guide portion and formed in the other of the head member and the side of the staple storage portion.

* * * * *